US007854403B2

(12) United States Patent
Yano et al.

(10) Patent No.: US 7,854,403 B2
(45) Date of Patent: Dec. 21, 2010

(54) ELECTROSTATICALLY ATOMIZING DEVICE

(75) Inventors: Takeshi Yano, Kyoto-shi (JP); Toshihisa Hirai, Hikone-shi (JP); Kishiko Hirai, legal representative, Hikone-shi (JP); Sumio Wada, Hikone-shi (JP); Akihide Sugawa, Hikone-shi (JP); Tatsuhiko Matsumoto, Habikino-shi (JP); Shousuke Akisada, Hikone-shi (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 435 days.

(21) Appl. No.: 12/091,637

(22) PCT Filed: Oct. 30, 2006

(86) PCT No.: PCT/JP2006/321622

§ 371 (c)(1),
(2), (4) Date: Apr. 25, 2008

(87) PCT Pub. No.: WO2007/052583

PCT Pub. Date: May 10, 2007

(65) Prior Publication Data

US 2010/0044476 A1 Feb. 25, 2010

(30) Foreign Application Priority Data

Oct. 31, 2005 (JP) ..... 2005-317578

(51) Int. Cl.
*B05B 5/00* (2006.01)

(52) U.S. Cl. ..... 239/700; 239/690.1

(58) Field of Classification Search ..... 239/690, 239/690.1, 700, 704–707, 290, 291; 95/71; 96/52, 53, 64, 65

See application file for complete search history.

(56) References Cited

U.S. PATENT DOCUMENTS 7,494,532 B2 * 2/2009 Azukizawa et al. ..... 96/27

(Continued)

FOREIGN PATENT DOCUMENTS

EP 1 733 798 A1 12/2006

(Continued)

OTHER PUBLICATIONS

Notification of Reasons for Refusal for the Application No. 2005-317578 from Japan Patent Office mailed Dec. 22, 2009.

(Continued)

*Primary Examiner*—Davis Hwu
(74) *Attorney, Agent, or Firm*—Cheng Law Group, PLLC

(57) ABSTRACT

An electrostatically atomizing device includes a housing and an electrostatically atomizing unit disposed within the housing. The atomizing unit includes an emitter electrode and an heat exchanger. The heat exchanger cools the emitter electrode to develop condensed water. A high voltage is applied to the emitter electrode in order to electrostatically atomizing the condensed water and generate a mist of charged minute water particles. The housing accommodates a fan generating an air flow accelerating a heat radiation of the heat exchanger, and a high voltage source generating the high voltage applied to the emitter electrode. The heat exchanger has its heat radiator section exposed to a flow passage of the air flow. The atomizing unit is formed with an air inlet for introducing the air flow which carries the mist of the charged minute water particles and release the mist. The atomizing unit and the high voltage source are arranged on opposite sides of the flow passage. A first air intake port for feeding the forced air flow from the fan and a second air intake port for feeding the air flow into the high voltage source are positioned upstream of a second air intake port which introduce the forced air flow into the flow passage.

4 Claims, 6 Drawing Sheets

U.S. PATENT DOCUMENTS

| | | | | |
|---|---|---|---|---|
| 7,503,512 | B2 * | 3/2009 | Nakada et al. | 239/690.1 |
| 7,621,470 | B2 * | 11/2009 | Yamaguchi et al. | 239/690 |
| 2008/0130189 | A1 | 6/2008 | Kobayashi et al. | |
| 2009/0001200 | A1 | 1/2009 | Imahori et al. | |

FOREIGN PATENT DOCUMENTS

| | | | |
|---|---|---|---|
| JP | 63-68178 | A | 3/1988 |
| JP | 10-103721 | A | 4/1998 |
| JP | 2000-176339 | A | 6/2000 |
| JP | 2000-245841 | A | 9/2000 |
| JP | 3260150 | B2 | 12/2001 |
| JP | 2005-131549 | A | 5/2005 |
| JP | 2005-296753 | A | 10/2005 |
| WO | WO-2005/097339 | A1 | 10/2005 |
| WO | WO-2007/052583 | A1 | 5/2007 |

OTHER PUBLICATIONS

International Search Report for the Application No. PCT/JP2006/321622 dated Jan. 23, 2007.

Notification of Reasons for Refusal for the Application No. 2005-317578 from Japan Patent Office mailed Sep. 7, 2010.

* cited by examiner

ELECTROSTATICALLY ATOMIZING DEVICE

TECHNICAL FIELD

The present invention is directed to an electrostatically atomizing device of electrostatically atomizing water into a mist of minute charged water particles of nanometer sizes.

As shown in international patent publication WO 2005/097339, an electrostatically atomizing device is known to electrostatically atomize water for generating a mist of charged minute particles of nanometer sizes. The electrostatically atomizing device has an emitter electrode, a water feed means for supplying the water to the emitter electrode, an atomizing barrel which defines an atomizing space in its interior and holds the emitter electrode in the space, and a high voltage applying section which applies a high voltage to the emitter electrode. With the high voltage applied to the emitter electrode, the water supplied on the emitter electrode is electrostatically atomized for generating the mist of charged minute particles of nanometer sizes.

In the electrostatically atomizing device, the water feed means is defined by a heat exchanger which has a cooling section and a heat radiator section. The cooling section is configured to cool the emitter electrode to allow the water to condense on the emitter electrode. A fan is provided to give an air flow to expedite heat radiation of the heat radiator section as well as to carry thereon the ions of nanometer sizes developed in an atomizing space on for discharging the same outwardly.

However, the prior electrostatically atomizing device is found difficult to supply the air flow of the fan towards the heat radiator section of the heat exchanger and the electrostatically atomizing unit individually or in a separate manner from each other. Further, in view of that the electrostatically atomizing unit of this kind is desired to incorporate a high voltage source responsible for generating a high voltage applied to the emitter electrode, the high voltage source may act, depending upon its position, to lower heat radiating effect by its heat, or even warm the emitter electrode. Consequently, the high voltage source is also desired to be cooled effectively.

DISCLOSURE OF THE INVENTION

In view of the above problem, the present invention has been accomplished to give a solution of realizing an electrostatically atomizing device in which an electrostatically atomizing unit is incorporated together with a heat exchanger, a cooling fan, and a high voltage source to achieve an effective heat radiation for effectively discharging a mist of charged minute water particles.

The electrostatically atomizing device in accordance with the present invention includes a housing and an electrostatically atomizing unit accommodated within the housing. The electrostatically atomizing unit includes an emitter electrode, an opposed electrode disposed in opposite relation to the emitter electrode, water supply means configured to supply water to the emitter electrode; and an atomizing barrel which surrounds the emitter electrode and is formed at its one axial end with a discharge port exposed to exterior of the housing. A high voltage source is disposed within the housing and is configured to apply a high voltage between the emitter electrode and the opposed electrode in order to electrostatically atomize the water supplied to emitter electrode for generating charged minute water particles and discharge the charged minute water particles through the opposed electrode out of the discharge port. The water supply means is composed of a heat exchanger having a cooling section and a heat radiator section. The emitter electrode is cooled by the cooling section to develop condensed water thereon. The housing includes a fan configured to generate a forced air flow of cooling the heat radiator section, and a straight flow passage which is configured to direct the forced air flow and to have the heat radiator section exposed therein. The atomizing barrel of the electrostatically atomizing unit is formed with an air inlet configured to introduce the air flow for carrying a mist of the charged minute water particles thereon and releasing it out of the housing. The electrostatically atomizing unit and the high voltage source are arranged on opposite sides of the flow passage. A first air intake port is provided to feed the forced air generated by the fan into the electrostatically atomizing unit, while a second air intake port is provided to feed the forced air flow into the flow passage. A third air intake port is provided to feed the forced air into the high voltage source. The first air intake port and the third air intake port are positioned upstream of the second air intake port. Because of that the electrostatically atomizing unit and the high voltage source are position on opposite sides of the flow passage of the air provided to cool the heat radiator section of the heat exchanger, and also because of that the air flow generated by the fan is supplied to the electrostatically atomizing unit and the high voltage source respectively through the first and third air intake ports both positioned upstream of the flow passage, it is realized to supply a non-heat exchanged fresh air to the electrostatically atomizing unit with an additional effect of promoting the heat radiation of the heat exchanger and cooling the high voltage source which is a heat source included in the housing, thereby assuring a stable generation of the mist of charged minute water particles without lessening the cooling effect of the emitter electrode.

Preferably, the housing is formed with a partition dividing an interior space of the housing into a first space and a second space. The first space receives therein the electrostatically atomizing unit and the fan, and is configured to form flow passage, while the second space receives therein the high voltage source, a rotation control circuit for controlling a rotation speed of the fan, and a temperature control circuit for controlling a cooling temperature of the heat exchanger. The third air intake port is formed in the partition. Thus, the rotation control circuit and the temperature control circuit can have improved heat radiation to be assured of stable operations.

Further, it is preferred that the housing has an exhaust port which is cooperative with the third air intake to define an air passage within the second space, and that a control module integrating the rotation control circuit and temperature control circuit is arrange along the air passage upstream of the high voltage source. With this arrangement, it is possible to thermally protect the rotation control circuit and the temperature control circuit from the high voltage source of large heat generating capacity, thereby assuring more stable operations.

Also, the partition is preferably formed with a hole which passes therethrough a lead wire connecting the high voltage source to the electrostatically atomizing unit.

BEST MODE FOR CARRYING OUT THE INVENTION

Figure 1:
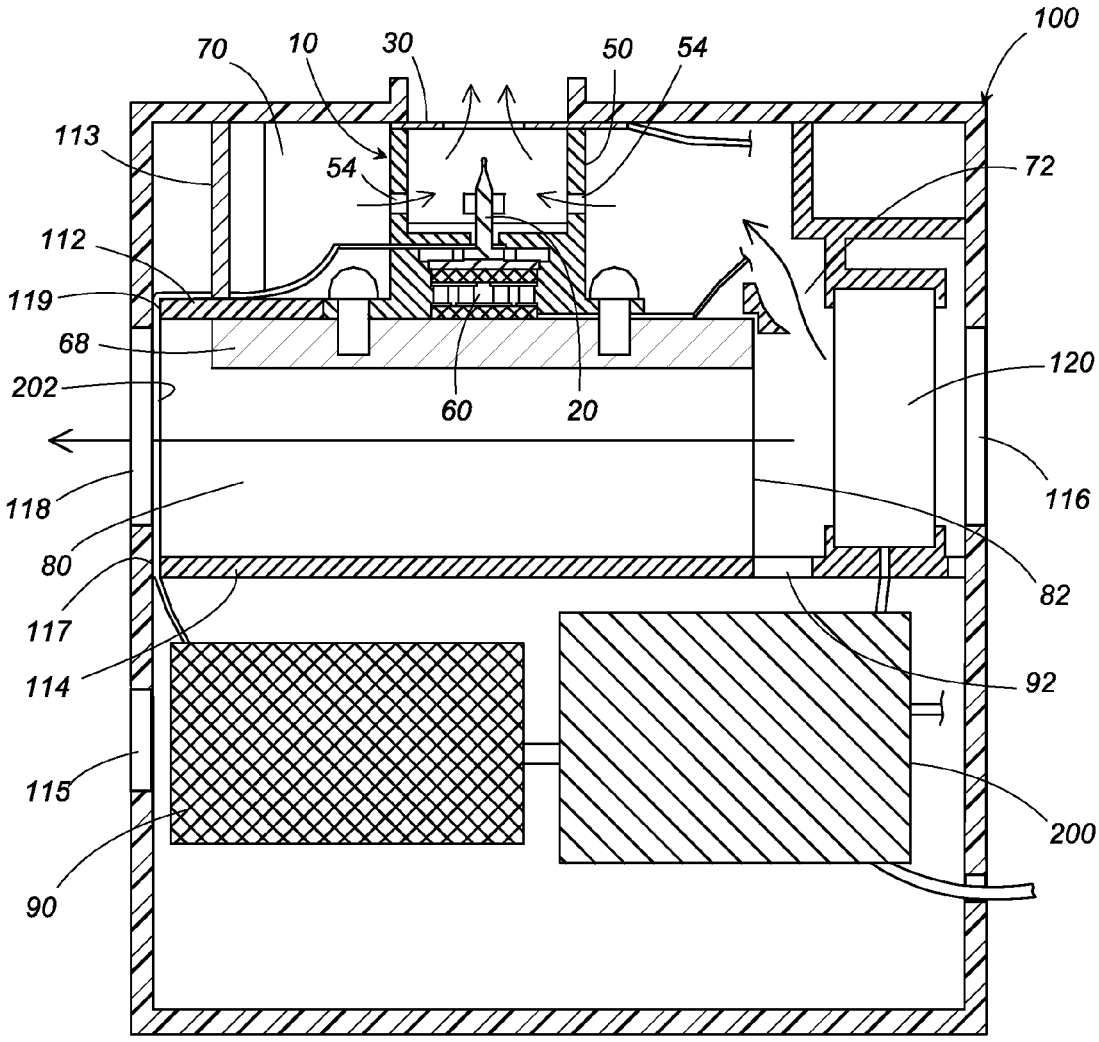
FIG. 1 is a vertical section of an electrostatically atomizing device in accordance with an embodiment of the present invention.
Figure 4:
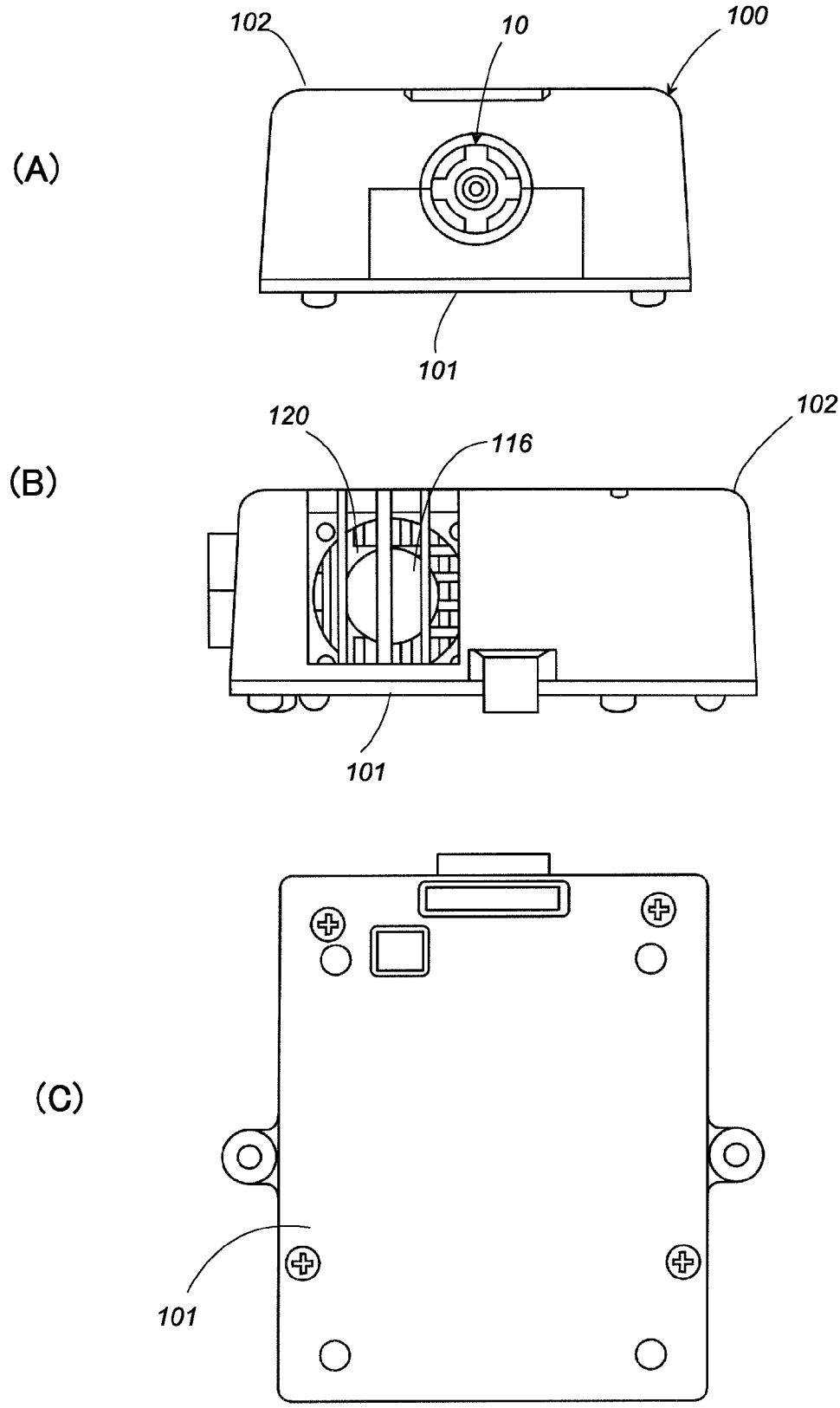
FIG. 4 is an external view of the above electrostatically atomizing device, (A) being a front view, (B) being a right side view, and (C) being a bottom view.

Now, a reference is made to the attached drawings to explain an electrostatically atomizing device in accordance with one embodiment of the present invention. As shown in FIG. 1, the electrostatically atomizing device includes an electrostatically atomizing unit 10 and a housing 100 accommodating the same. The housing 100 is composed, as shown in FIG. 4, of a case body 101 and a case lid 102 closing one face of the case body 101.

Figure 2:
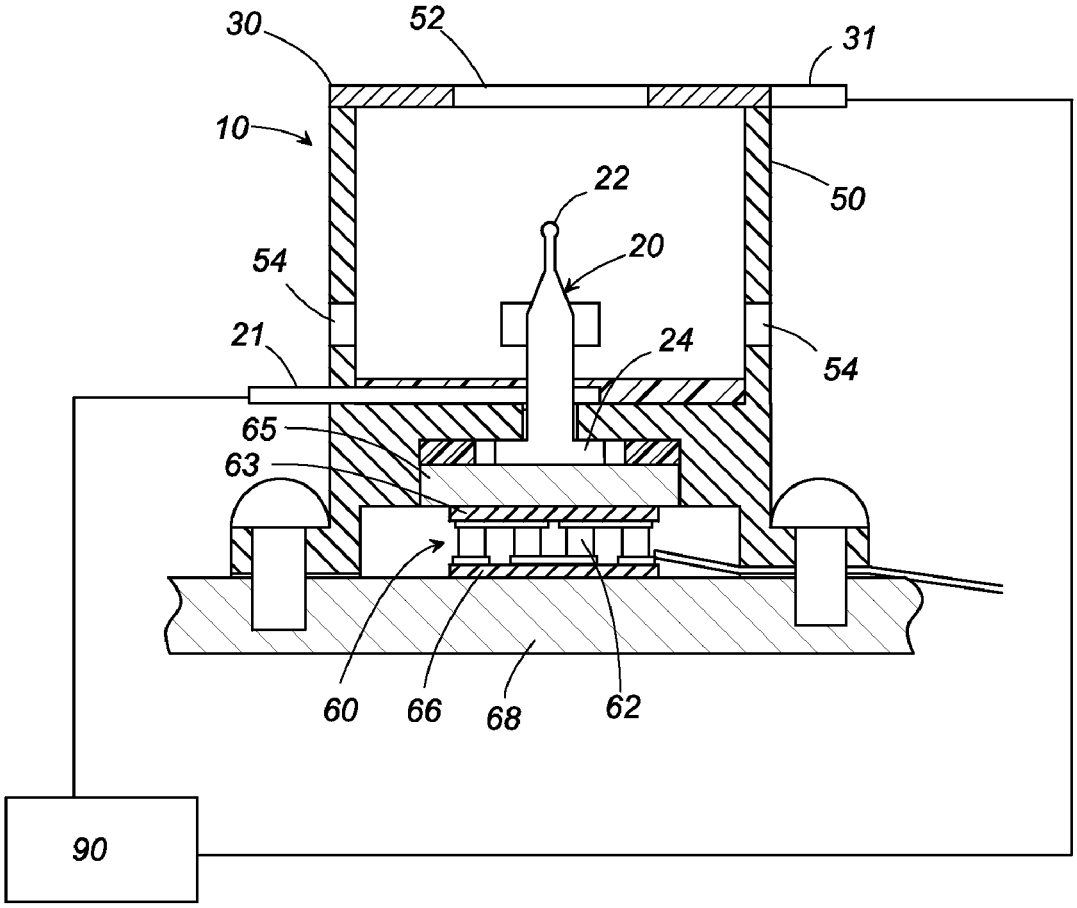
FIG. 2 is a cross section of an electrostatically atomizing unit utilized in the above electrostatically atomizing device.

As best shown in FIG. 2, the electrostatically atomizing unit 10 includes an atomizing barrel 50 configured to hold an emitter electrode 20, an opposed electrode 30, and a heat exchanger 40. The emitter electrode 20 is disposed on a center axis of the atomizing barrel 50 to have its rear end fixed to a bottom wall 51 of the atomizing barrel 50 and to have its tip projecting into the atomizing barrel 50. The opposed electrode 30 is ring-shaped to have a center circular window and is fixed to the front end of the atomizing barrel 50 in an axially spaced relation from a discharge end of the emitter electrode with the center of the circular window 52 aligned with the center axis of the atomizing barrel 50. The circular window defines a discharge port at the front end of the atomizing barrel 50. The emitter electrode 20 and the opposed electrode 30 are connected to a high voltage source 90 respectively through an electrode terminal 21 and a ground terminal 31. The high voltage source 90 is realized by a transformer to apply a predetermined high voltage between the emitter electrode 20 and the grounded opposed electrode 30. A negative voltage (for example, −4.6 kV) is applied to the emitter electrode 20 to develop a high voltage electric field between the discharge end 22 of the emitter electrode 20 and an inner periphery of the circular window 32 of the opposed electrode 30, to thereby electrostatically charge the water supplied to the emitter electrode 20, as will discussed later, and discharge a mist of charged minute water particles from the discharge end 22.

Figure 5:
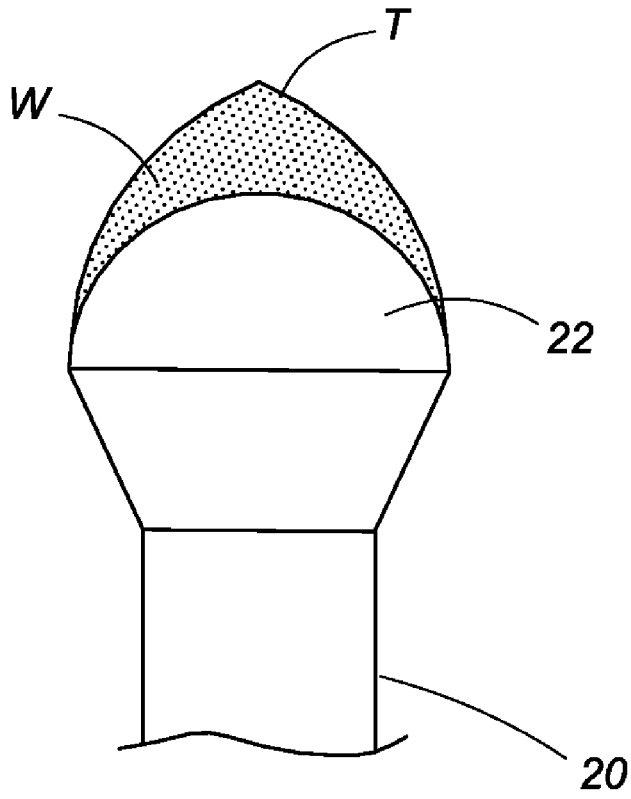
FIG. 5 is a schematic view explaining formation of Taylor cone developed at an emitter electrode of the above electrostatically atomizing device.
Figure 6:
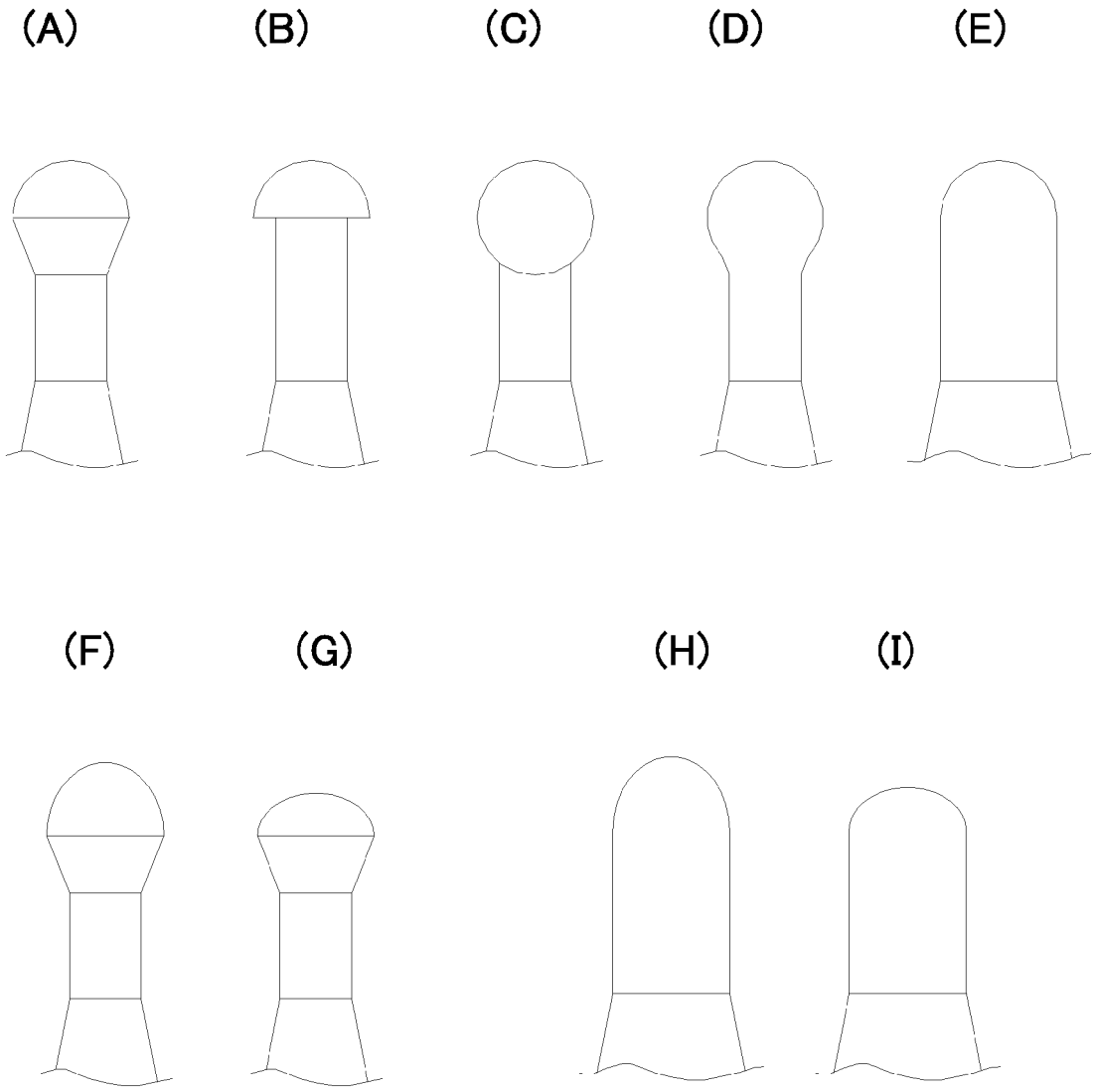
FIGS. 6(A), (B), (C), (D), (E), (F), (G), (H), (I) are partly cutout front views showing respectively examples of the emitter electrode utilized in the above electrostatically atomizing device.

In this instance, the high voltage applied between the emitter electrode 20 and the opposed electrode 30 develops a Coulomb force between the water W held at the discharge end 22 of the emitter electrode 20 and the opposed electrode 30, as shown in FIG. 5, thereby forming a Taylor cone T. Then, electric charges concentrate to a tip of the Taylor cone T to increase the electric field intensity and therefore the Coulomb force, thereby further developing the Taylor cone T. Upon the Coulomb force exceeding the surface tension of the water W, the Taylor cone T is caused to disintegrate repeatedly (Rayleigh disintegration) to generate a large amount of the mist including charged minute water particles of nanometer sizes. The mist goes toward the opposed electrodes 30 and is discharged outwardly through the discharge port 52. A plural of air inlets 54 are disposed in the peripheral wall of the atomizing barrel 50 to introduce a pressurized air so that the mist is carried on the air to be discharged out of the outlet port 52.

Mounted on the back side of the bottom wall of the atomizing barrel 50 is a heat exchanger 60 composed of a Peltier-effect thermoelectric module having a cooling side which is coupled to the emitter electrode 20 to cool the emitter electrode 20 below a dew point temperature of water for condensing the moisture in the ambient air on the emitter electrode. In this sense, the heat exchanger 60 defines a water feed means which supplies the water onto the emitter electrode 20. The heat exchanger 60 is composed of a plurality of thermoelectric elements 62 connected in parallel between a pair of electrically conductive circuit plates, and operates to cool the emitter electrode 20 at a cooling rate determined by a variable voltage given from a control module 200 accommodated in the housing. One of the conductive circuit plates at the cooling side is thermally coupled to a flange 24 at the rear end of the emitter electrode 20 through dielectric members 63 and 65, while the other conductive circuit plate on the heat radiator side is thermally coupled to a heat radiating plate 68 through a dielectric member 66. The radiating plate 68 is fixed to the rear end of the atomizing barrel 50 to hold the heat exchanger 60 between the heat radiating plate and the bottom wall 51 of the atomizing barrel 50. The heat radiating plate 68 may be provided with heat radiating fins for accelerating heat radiation. The controller module 200 is configured to control the heat exchanger 60 in order to keep the electrode at a suitable temperature in accordance with the ambient temperature and humidity, i.e., the temperate at which a sufficient amount of water is condensed on the emitter electrode.

As shown in FIG. 1, the electrostatically atomizing unit 10 of the above configuration is disposed in the center of the front end part (upward end in FIG. 1) of the housing 100 where the fan 120 is incorporated, so as to align the outlet port 52 at the front end of the atomizing barrel 50 with an opening formed in the front end of the housing 100. The housing 100 is provided with a front partition wall 112 and a back partition wall 114. The front partition wall 112 is combined to the rear end of the atomizing barrel 50 and also to the heat radiating plate 68, thereby forming an air pressure chamber 70 around the atomizing barrel 50 for introducing the pressurized air generated by the fan 120 into the air pressure chamber 70. The air pressure chamber 70 is configured to take in the pressurized air only from a first air intake 72 disposed in an adjacent relation to the fan 120, and is isolated from other parts within the housing 100 so as not to take in an air through the other portion. The fan 120 takes in the air through an air intake 116 located on one side of the housing 100 to supply the pressurized air through the first air intake 72 into the air pressure chamber 70. The pressurized air is introduced through air inlets 54 of the electrostatically atomizing unit 10 into the atomizing barrel 50 and produces an air flow discharged from the outlet port 52 of the atomizing barrel 50. Thus, the mist is carried on the air flow to be discharged out of the housing 100.

A linear flow passage 80 is formed between the front partition wall 112, the heat radiating plate 68 and the back partition wall 114 to take in the air from the fan 120 through a second air intake 82 at one end of the flow passage, and discharge it through an opening at the other end of the flow passage 80 and outwardly through an outlet port 118 formed in the side of the housing 100. The back partition wall 114 is formed to extend over the full length in the lateral direction of the housing 100 to define a first space forwardly of the back partition wall for accommodating the electrostatically atomizing unit 10, the fan 120, the air pressure chamber 70, and the flow passage 80, and to define a second space rearwardly of the partition 114 for accommodating the high voltage source 90. With this consequence, the electrostatically atomizing unit 10 and the high voltage source 90 are disposed, in an isolated relation from each other, on opposite sides of the linear flow passage 80, i.e., within the front first space and the rear second space on opposite sides of the flow passage 80.

Within the space formed in the housing 100 rearwardly of the back partition wall 114, there is accommodated, in addition to the high voltage source 90, a controller module 200 which controls the cooling temperature of the emitter electrode 20 by the heat exchanger 60 as well as the air flow generated by the fan 120. The controller module 200 is configured to integrate a temperature control circuit and a rotation control circuit. The temperature control circuit controls the temperature of the cooling side of the heat exchanger 60 in order to allow the water to condense on the emitter electrode 20 depending upon the ambient temperature and humidity, while the rotation control circuit controls the rotation speed of the fan 120 depending upon the temperature of the emitter electrode 20. These control circuits give the control signals based upon a temperature sensor and a humidity sensor provided within the housing 100 for control of the heat exchanger 60 and the fan 120. A third air intake 92 is formed in the back partition wall 114 to take in the air flow from the fan 120 and accelerates the radiation of heat generated within the space. The air introduced into the space is discharged outwardly through an outlet port 115 disposed on the side of the housing 100. The first air intake 72 and the third air intake 92 are provided upstream of the second air intake 82 of the flow passage 80 to supply fresh air to the electrostatically atomizing unit 10 as well as the high voltage source 90 and the controller module 200.

The controller module 200 is provided upstream of the high voltage source 90 within the flow passage extending from the third air intake 92 to the outlet port 115 so as to be protected from the heat of the high voltage source 90 of a large heat capacity, assuring a stable control performance. A hole 117 in the form of a notch is provided at one end of the rear partition wall 114 opposite to the one end of the housing 100 where the outlet port 115 is provided. A lead 202 extending from the high voltage source 200 is routed through the hole 117 and a hole 119 at one end of the front partition wall 112 for connection with the electrostatically atomizing unit 10.

Figure 3:
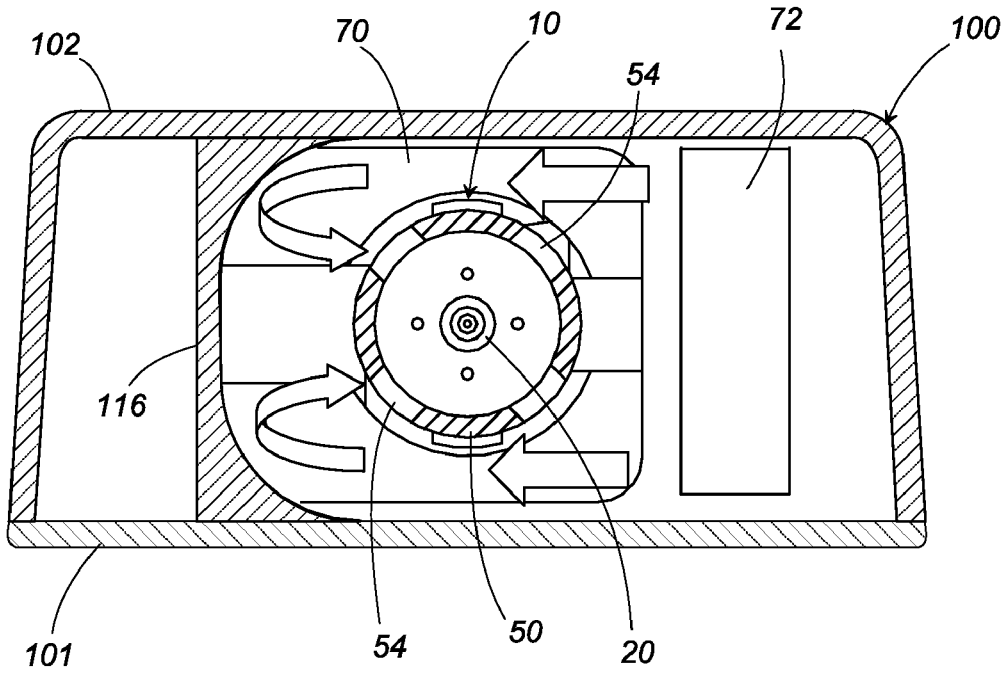
FIG. 3 is a partly cutout top view of the above electrostatically atomizing device.

As shown in FIG. 3, the air inlets 54 are equiangularly spaced along the circumference of the atomizing barrel 50 to be diametrically opposed with each other about the axis of the atomizing barrel 50. Thus, the pressurized air is caused to flow uniformly towards the emitter electrode 20 at the axial center of the atomizing barrel 50, restraining an eddy flow within the atomizing barrel 50 and therefore enabling to generate the air flow effectively for discharging the mist out of the outlet port 52. Further, as shown in this figure, a side wall 113 has its interior surface curved at a portion opposite of the first air intake 72 from the electrostatically atomizing unit 10 to give a curved surface spaced roughly by a constant distance from the exterior of the atomizing barrel 50, thereby avoiding a turbulent flow in the space confined therebetween and permitting the pressurized air to be effectively introduced in the atomizing barrel 50 through the air inlets 54, and therefore enabling to discharge the mist generated at the atomizing barrel 50 outwardly in an effective manner.

The emitter electrode 20 is preferably formed with a concave 28 immediately behind the discharge end 22 of a rounded tip. With the provision of the concave, the water condensed on the emitter electrode 20 at a portion other than the discharge end 22 is restrained from being excessively absorbed into the Taylor cone formed at the discharge end 22, assuring stable formation of the Taylor cone T of the constant size and shape to stably generate the negative ion mist of the reduced particle size of nanometer order.

The emitter electrode 20 of the other shapes, as shown in FIGS. 6(A)~(I), may be utilized.

The invention claimed is:

1. An electrostatically atomizing device comprising a housing and an electrostatically atomizing unit accommodated within said housing, said electrostatically atomizing unit comprising:

an emitter electrode;

an opposed electrode disposed in opposite relation to said emitter electrode;

water supply means configured to supply water to said emitter electrode; and an atomizing barrel configured to surround said emitter electrode, said atomizing barrel being formed at its one axial end with a discharge port exposed to exterior of said housing;

a high voltage source being disposed within said housing and configured to apply a high voltage between said emitter electrode and said opposed electrode in order to electrostatically atomize the water supplied to emitter electrode for generating charged minute water particles and discharge said charged minute water particles through said opposed electrode out of said discharge port;

wherein said water supply means comprising a heat exchanger having a cooling section and a heat radiator section, said cooling section cooling said emitter electrode to develop condensed water on said emitter electrode;

said housing including a fan configured to generate a forced air flow for cooling said heat radiator section, and a straight flow passage configured to direct said forced air flow and to have said heat radiator section exposed therein, said atomizing barrel of the electrostatically atomizing unit being formed with an air inlet configured to introduce said air flow for carrying a mist of the charged minute water particles on said air flow and releasing it out of said housing, said electrostatically atomizing unit and said high voltage source being arranged on opposite sides of said flow passage, a first air intake port being provided to feed said forced air generated by said fan into said electrostatically atomizing unit, a second air intake port being provided to feed said forced air flow into said flow passage, a third air intake port being provided to feed said forced air into said high voltage source, and said first air intake port and said third air intake port being positioned upstream of said second air intake port.

2. An electrostatically atomizing device as set forth in claim 1, wherein said housing is formed with a partition dividing an interior space of said housing into a first space and a second space, said first space receiving therein said electrostatically atomizing unit and said fan, and forming said flow passage, said second space receiving therein said high voltage source, a rotation control circuit for controlling a rotation speed of said fan, and a temperature control circuit for controlling a cooling temperature of said heat exchanger, and said partition being formed with said third air intake port.

3. An electrostatically atomizing device as set forth in claim 2, wherein said housing has an exhaust port which is cooperative with said third air intake to define an air passage within said second space, a control module which is configured to integrate said rotation control circuit and said temperature control circuit being arrange along said air passage upstream of said high voltage source.

4. An electrostatically atomizing device as set forth in claim 2, wherein said partition is formed with a hole which passes therethrough a lead wire connecting said high voltage source to said electrostatically atomizing unit.

* * * * *